US007851718B2

(12) United States Patent
Shibuya et al.

(10) Patent No.: US 7,851,718 B2
(45) Date of Patent: Dec. 14, 2010

(54) ELECTRONIC EQUIPMENT

(75) Inventors: Seiji Shibuya, Osaka (JP); Takayoshi Yamasaki, Osaka (JP); Hiroichi Yoshida, Osaka (JP); Hiroya Morikawa, Osaka (JP)

(73) Assignee: Panasonic Corporation, Osaka (JP)

( * ) Notice: Subject to any disclaimer, the term of this patent is extended or adjusted under 35 U.S.C. 154(b) by 204 days.

(21) Appl. No.: 12/054,904

(22) Filed: Mar. 25, 2008

(65) Prior Publication Data

US 2008/0237013 A1 Oct. 2, 2008

(30) Foreign Application Priority Data

Mar. 29, 2007 (JP) ..... 2007-089348

(51) Int. Cl.
*H01H 13/70* (2006.01)

(52) U.S. Cl. ..... 200/517; 200/5 A

(58) Field of Classification Search ..... 200/5 A, 200/512, 515, 517
See application file for complete search history.

(56) References Cited

U.S. PATENT DOCUMENTS 3,742,157 A * 6/1973 Leposavic ..... 200/5 A
3,800,104 A * 3/1974 Lien et al. ..... 200/5 A
3,909,564 A * 9/1975 Scheingold et al. ..... 200/5 E
4,032,729 A * 6/1977 Koistinen ..... 200/5 A
4,847,452 A * 7/1989 Inaba ..... 200/5 A
6,080,940 A * 6/2000 Rice ..... 200/5 A
7,348,513 B2 * 3/2008 Lin ..... 200/512

FOREIGN PATENT DOCUMENTS

JP 8-161970 6/1996
JP 2002-008482 1/2002

* cited by examiner

*Primary Examiner*—Renee S Luebke
*Assistant Examiner*—Lisa Klaus
(74) *Attorney, Agent, or Firm*—Hamre, Schumann, Mueller & Larson, P.C.

(57) ABSTRACT

Electronic equipment of the present invention includes a first housing 2 with an elastically deformable thin-wall portion 25 formed as a part of the front wall, an elastically deformable spacer member 4, and a sub board 5 on which switches 51 are mounted. The spacer member 4 includes a plurality of elastic members 41 and a second supporting member 46. Each of the elastic members 41 includes an operating strip 41*a* that is formed so that when the thin-wall portion 25 is deformed elastically, one surface of the operating strip 41*a* can be brought into contact with a back surface of the thin-wall portion 25 and the other surface can be pressed against the switch 51. The second supporting member 46 is formed so as to protrude between each of the elastic members 41, and can be brought into contact with the back surface of the thin-wall portion 25 at least when the thin-wall portion 25 is deformed elastically. The elastic members 41 and the second supporting member 46 are formed integrally. With this configuration, the electronic equipment does not cause an operation error in which a plurality of switches are pressed simultaneously.

3 Claims, 8 Drawing Sheets

ELECTRONIC EQUIPMENT

BACKGROUND OF THE INVENTION

1. Field of the Invention

The present invention relates to electronic equipment including an operating device that can be operated by pressure.

2. Description of Related Art

In recent years, a portable audio player using a memory card as a storage medium has been widespread remarkably. The portable audio player stores music data in a built-in semiconductor memory or a removable memory card, and allows a user to enjoy listening to the music while on the move with this player. Portable electronic equipment such as a portable audio player generally is designed to prevent dust or water from entering the inside of the equipment with outdoor use in mind. In particular, operating buttons mounted on the electronic equipment are movable parts, and therefore it is highly probable that water etc. enters through the gaps between the operating buttons and a housing. Thus, various configurations to protect the electronic equipment from the intrusion of water etc. have been proposed.

For example, Patent Document 1 (JP 2002-8482 A) discloses a configuration in which a band (control member) that can be operated by pressure applied by a user is fused with a case body so as to prevent water from entering the inside of the case body.

However, if this configuration of Patent Document 1 includes a plurality of push-button operating members in the band and switches arranged under each of the operating members, an operation error can be caused such that when a user pushes one of the operating members, the band is deformed and pressed not only against the desired switch, but also against the adjacent switches simultaneously.

SUMMARY OF THE INVENTION

It is an object of the present invention to provide electronic equipment that does not cause an operation error in which a plurality of switches are pressed simultaneously.

Electronic equipment of the present invention includes the following: a housing with an elastically deformable thin-wall portion formed as a part of the front wall; an elastically deformable spacer member located on the back side of the thin-wall portion in the housing; and a sub board on which switches that can be pressed by the spacer member are mounted. The spacer member includes a plurality of elastic members and a supporting member. Each of the elastic members includes an operating strip that is formed so that when the thin-wall portion is deformed elastically, one surface of the operating strip can be brought into contact with a back surface of the thin-wall portion and the other surface can be pressed against the switch. The supporting member is formed so as to protrude between each of the elastic members, and can be brought into contact with the back surface of the thin-wall portion at least when the thin-wall portion is deformed elastically. The elastic members and the supporting member are formed integrally.

According to the present invention, the electronic equipment does not suffer from an operation error in which a plurality of switches are pressed simultaneously. Moreover, the electronic equipment is of good integrated design.

DETAILED DESCRIPTION OF THE INVENTION

Figure 1:
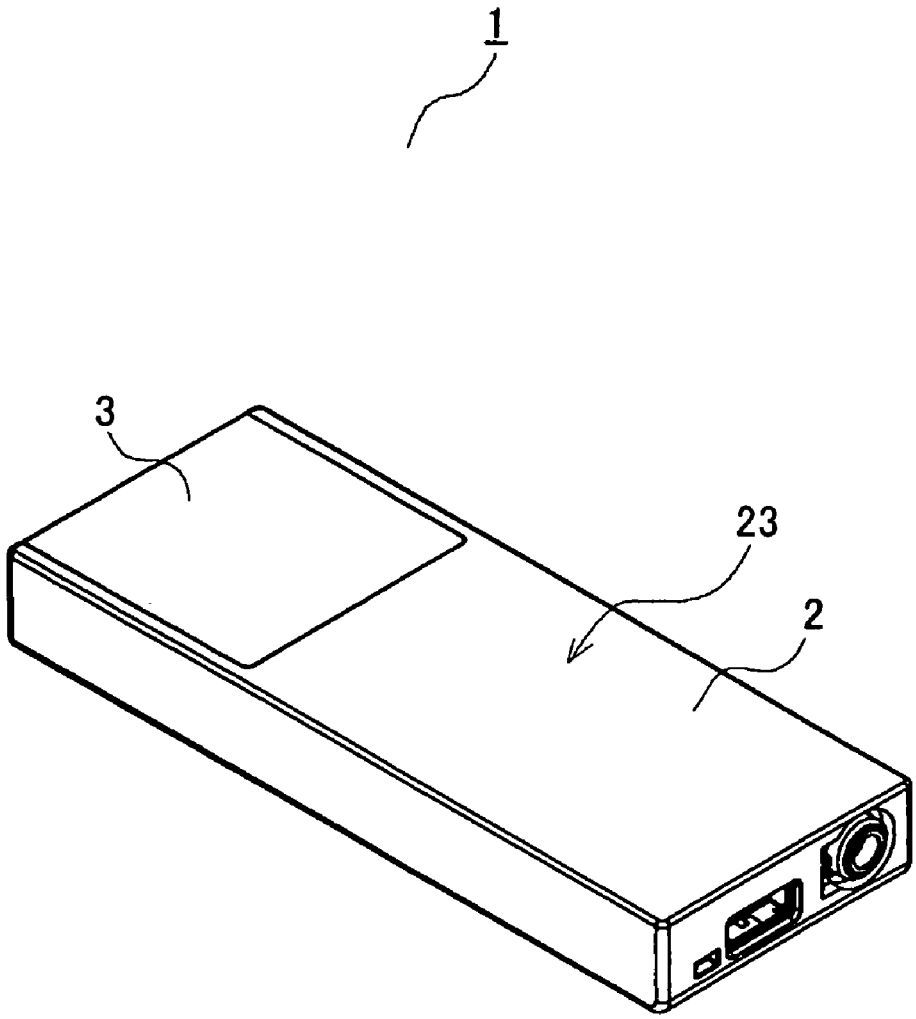
FIG. 1 is a perspective view of electronic equipment of an embodiment.

In the electronic equipment of the present invention, the spacer member may include a supporting member that prevents deformation of the periphery of at least the thin-wall portion. This configuration can prevent stress concentration on the periphery when the operating surface is pushed, and thus can prevent a fracture of the housing.

In the electronic equipment of the present invention, the spacer member may include openings and a bridging portion that holds arms for supporting the operating strips so that each of the operating strips is placed in the opening and can be brought into contact with the back surface of the thin-wall portion. The supporting member may be formed in the bridging portion.

In the electronic equipment of the present invention, the surface of the bridging portion may be positioned lower than the upper surfaces of the supporting member and the operating strips, and the arms are formed so as to extend from each of the operating strips to the bridging portion with a bend therebetween.

In the electronic equipment of the present invention, the housing may have curved portions on the periphery of the back surface of the thin-wall portion. This configuration can prevent stress concentration on the periphery when the operating surface is pushed, and thus can prevent a fracture of the housing.

In the electronic equipment of the present invention, a distance between the supporting member and the back surface of the thin-wall portion may be larger than that between the operating strip and the back surface of the thin-wall portion. With this configuration, the thin-wall portion comes into contact with the operating strip before reaching the supporting member during the push operation. Therefore, an operation error in which adjacent switches are pressed simultaneously can be prevented without impairing the operability.

In the electronic equipment of the present invention, the spacer member may include a bridging portion; an inner elastic portion located near the center of the spacer member; and an outer elastic portion located near the periphery of the spacer member. Each of the elastic members included in the inner elastic portion and the outer elastic portion has an elastically deformable arm that is connected between the operating strip and the bridging portion. The arms of the elastic members in the outer elastic portion may be longer than those of the elastic members in the inner elastic portion. This configuration can make the rigidity of the outer elastic portion lower than that of the inner elastic portion. Therefore, even when a user pushes the peripheral portion of the operating surface where the rigidity is high, the switch can be pressed reliably with a small amount of deformation of the thin-wall portion.

In the electronic equipment of the present invention, the supporting member may be formed of an elastic member. This configuration can prevent the appearance of an edge line of the supporting member on the thin-wall portion of the housing.

EMBODIMENT

[1. Configuration of the Electronic Equipment]

FIG. 1 shows the appearance of electronic equipment according to an embodiment of the present invention. The electronic equipment of the present invention is applicable to various types of electronic equipment such as a portable audio player, a portable telephone, a digital still camera, and a personal computer. In this embodiment, a portable audio player will be described as an example of the electronic equipment.

A main unit 1 is provided with a removable memory card that stores music data. The main unit 1 also may contain a semiconductor memory for storing music data. Moreover, the main unit 1 is capable of reading the music data stored in the memory card or the semiconductor memory and reproducing it. The main unit 1 has an operating surface 23 on the front surface of a first housing 2. When a user pushes a predetermined position of the operating surface 23, the main unit 1 can start and stop the reproducing operation, select a piece of music, or the like. The main unit 1 also has a transparent or semi-transparent panel 3 on the same surface as the operating surface 23. A display element 61 (as will be described later) for displaying various types of information including the name of music is disposed inside the panel 3.

Figure 2:
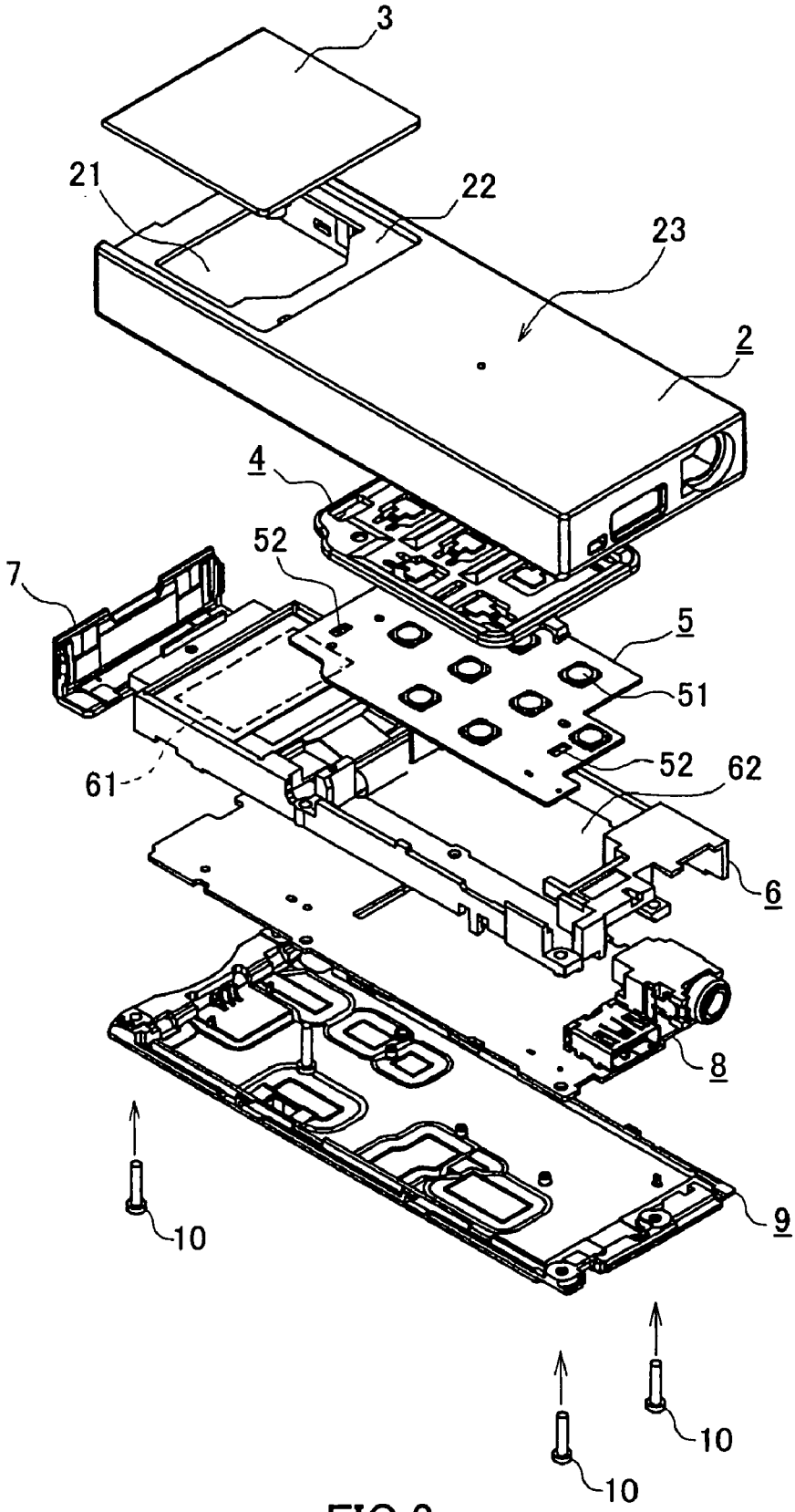
FIG. 2 is an exploded perspective view of the electronic equipment of the embodiment.
Figure 3:
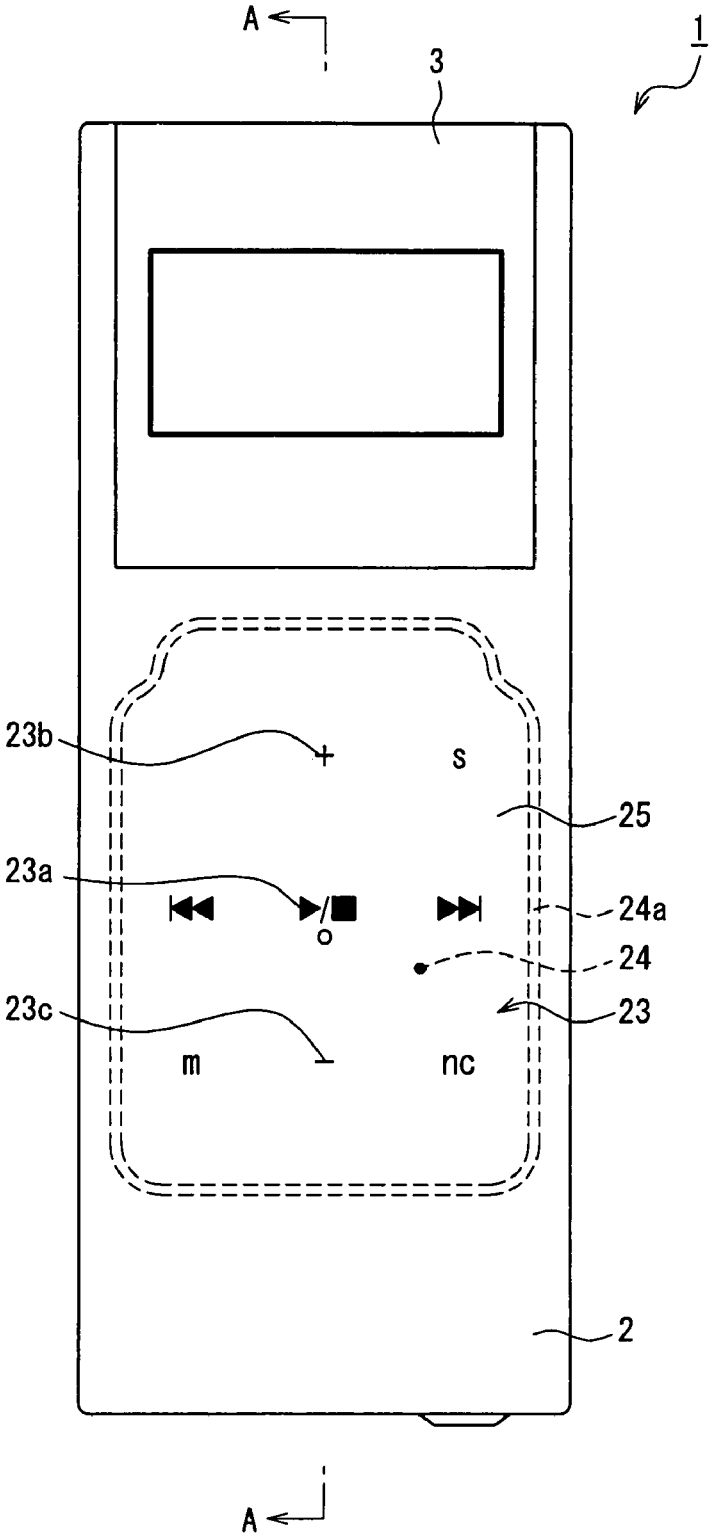
FIG. 3 is plan view of the electronic equipment of the embodiment.

FIG. 2 shows the internal configuration of the electronic equipment. FIG. 3 is a plan view of the electronic equipment. As shown in FIG. 2, the first housing 2 is provided with an opening 21, a recessed portion 22, the operating surface 23, a concave portion 24, and a thin-wall portion 25. The first housing 2 may be formed of a resin or the like by integral molding.

The opening 21 is formed so as to make a display portion of the display element 61 in the main unit 1 visible from the outside. Elastic (e.g., rubber) packing may be fitted around the opening 21 on the inside of the first housing 2. This can prevent the intrusion of water etc. into the first housing 2, even if they pass through the opening 21.

The recessed portion 22 is formed in the surface of the first housing 2, to which the panel 3 is attached. In this embodiment, the depth of the recessed portion 22 is the same as the thickness of the panel 3. Therefore, when the panel 3 is attached to the recessed portion 22, the surface of the panel 3 is substantially flush with the operating surface 23.

The operating surface 23 is subjected to pressure applied by a user during operation of the electronic equipment. The operating surface 23 is in the form of a plane. As shown in FIG. 3, the operating surface 23 has characters or marks that indicate various types of operations such as a play/pause mark 23*a*, a volume up mark 23*b*, and a volume down mark 23*c*. A user pushes the portions of the operating surface 23 indicated by the marks, and thus can press switches 51 located under these marks. Accordingly, the function corresponding to each of the marks can be performed.

The concave portion 24 is formed on the back side of the operating surface 23 (i.e., the inner surface of the first housing 2). Thus, the thin-wall portion 25 is provided with the operating surface 23 on the front side and the concave portion 24 on the back side. The thin-wall portion 25 is deformed elastically when the operating surface 23 is pushed in the normal direction. In the first housing 2, the portions other than the thin-wall portion 25 are thick and have a strength sufficient to resist elastic deformation. The size of the bottom of the concave portion 24 is slightly larger than the perimeter of a spacer member 4. The concave portion 24 may be formed at the same time that the first housing 2 is formed by integral molding. In this embodiment, however, only the concave portion 24 is formed by a cutting process. Moreover, curved portions 24*a* are provided on the inner surface of the concave portion 24. The curved portions 24*a* serve to disperse the stress applied to the inner surface of the concave portion 24 when the thin-wall portion 25 is deformed elastically by pushing the operating surface 23. Therefore, the occurrence of cracks or the like on the inner surface of the concave portion 24 can be suppressed, even if the operating surface 23 is pushed repeatedly. The curved portions 24*a* may be formed during the cutting process of the concave portion 24.

Since the panel 3 is formed of a transparent or semi-transparent member, the information displayed on the display element 61 can be seen from the outside. The panel 3 is attached to the recessed portion 22 of the first housing 2 with an adhesive or the like, but may be fixed in another way as long as it can prevent water etc. from entering at least the inside of the main unit 1.

The spacer member 4 is disposed between the first housing 2 and a sub board 5 (so-called operating board), and can be pressed against each of the switches 51 when a user pushes the predetermined portions of the operating surface 23. Moreover, elastic members 41 are formed integrally with the spacer member 4 at the positions corresponding to the marks etc. on the operating surface 23. In response to the push operation of the operating surface 23, the elastic members 41 are pressed by the back surface opposite to the operating surface 23, and can be deformed elastically. The spacer member 4 may be formed of an elastically deformable material such as a resin by integral molding. The detailed configuration of the spacer member 4 will be described later.

The switches 51 are mounted on the sub board 5 at the positions opposite to the elastic members 41 of the spacer member 4. Each of the switches 51 arranged on the sub board 5 is assigned to the function that corresponds to the mark on the operating surface 23. When the operating surface 23 is pushed, the switch 51 is pressed by the elastic member 41.

A chassis 6 is fixed inside the first housing 2 so that the sub board 5 is sandwiched between the spacer member 4 and the chassis 6. The chassis 6 includes the display element 61 and a cavity 62. The display element 61 is composed of an organic EL element or a liquid crystal display element. The cavity 62 is a space where a battery (not shown) is placed for supplying power to each component such as a main board 8.

A third housing 7 is attached to the end of the first housing 2 and covers it. The third housing 7 is not essential and may be formed integrally with the first housing 2 or a second housing 9.

The main board 8, on which various types of signal processing microcomputers, terminals for receiving signals, or the like are mounted, is secured to the chassis 6 by screws.

The second housing 9 is secured to the first housing 2 by screws 10 and covers the underside of the main unit 1.

For assembly of the main unit 1, first, the panel 3 is attached to the recessed portion 22 of the first housing 2. Then, the spacer member 4, the sub board 5, the chassis 6, and the main board 8 are accommodated in the first housing 2. Subsequently, the second housing 9 and the third housing 7 are attached temporarily to the first housing 2. At this time, the spacer member 4 is placed in the concave portion 24 of the first housing 2. Finally, the screws 10 are inserted through holes in the second housing 9, holes in the main board 8, and holes in the chassis 6 or the third housing 7 in this order, and fitted threadably into screw holes formed in the inner surface of the first housing 2.

[2. Configuration of the Spacer Member 4]

Figure 4:
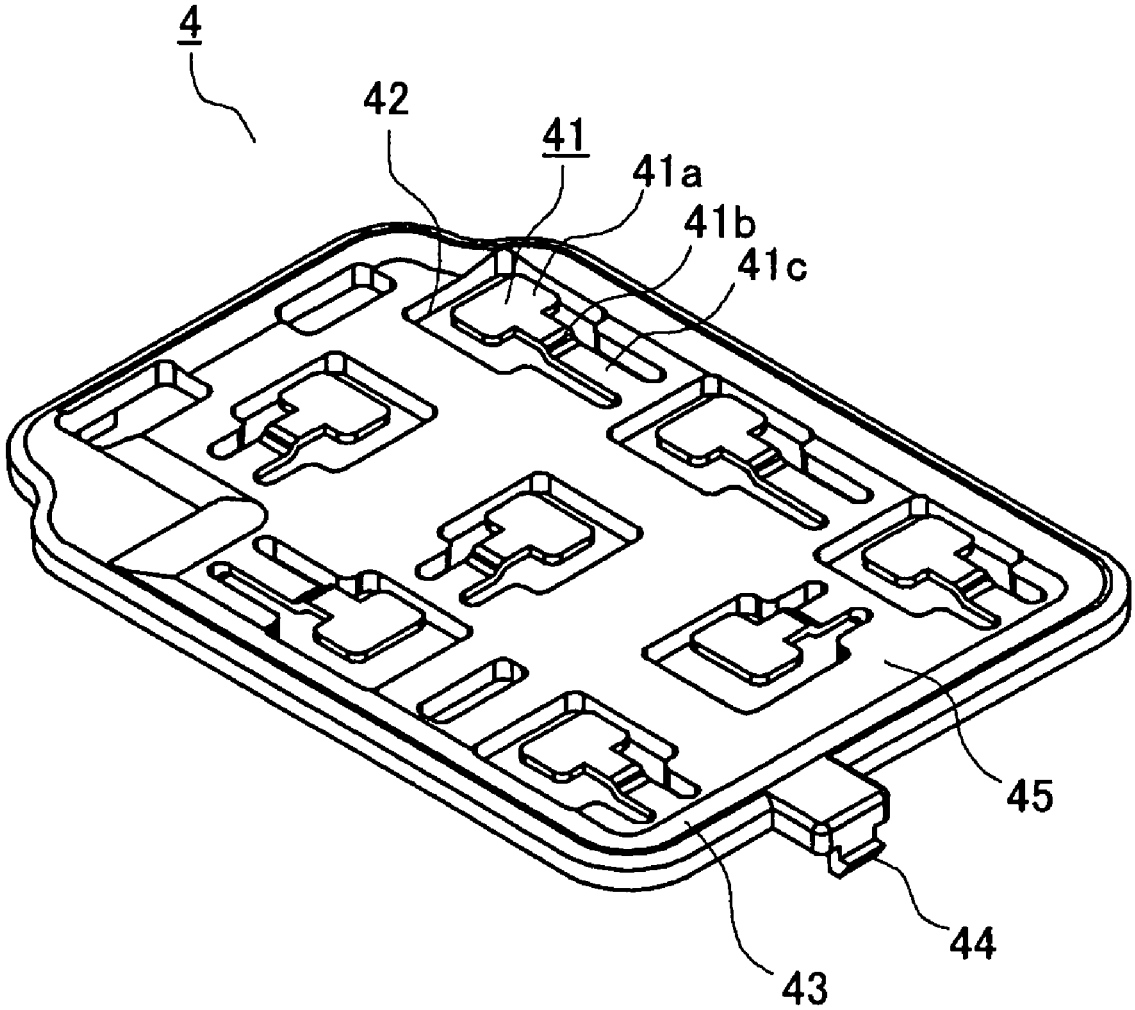
FIG. 4 is a perspective view showing a configuration of a spacer member of the embodiment.
Figure 5A:
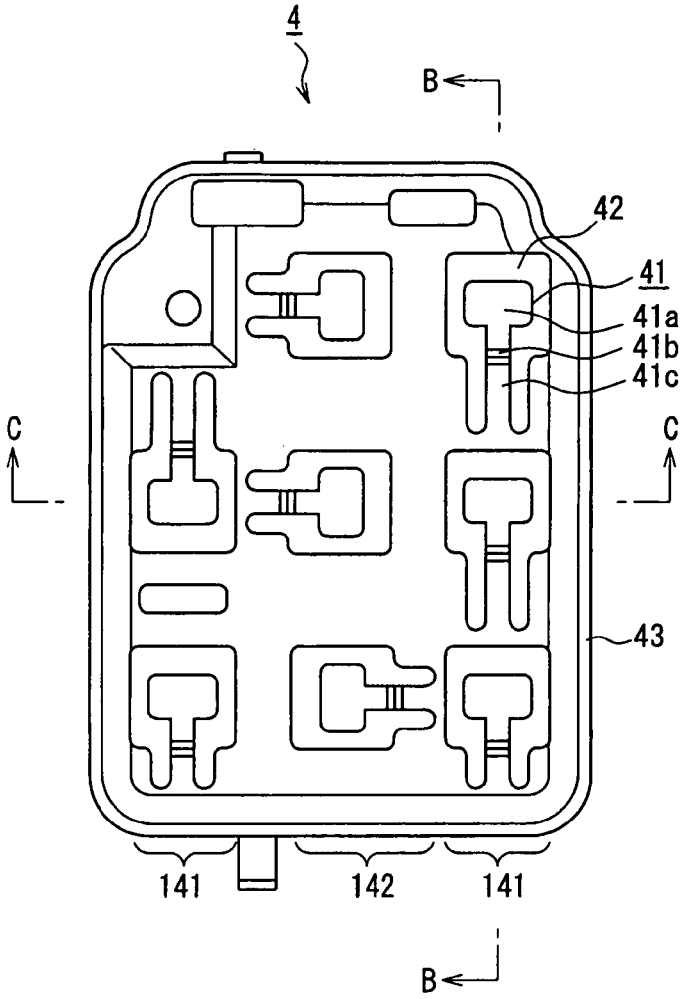
FIG. 5A is a plan view showing the configuration of the spacer member in FIG. 4.
Figure 5B:
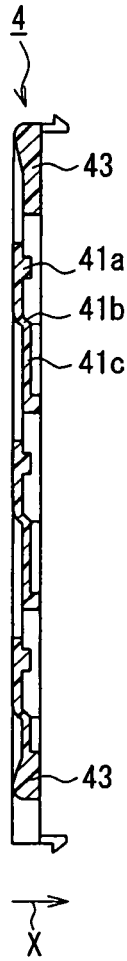
FIG. 5B is a cross-sectional view showing the configuration of the spacer member in FIG. 4.
Figure 5C:
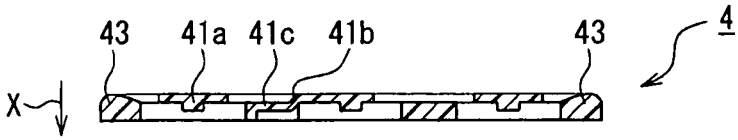
FIG. 5C is a cross-sectional view showing the configuration of the spacer member in FIG. 4.

FIG. 4 is a perspective view of the spacer member 4. FIG. 5A is a plan view of the spacer member 4. FIG. 5B is a cross-sectional view taken along the line B-B in FIG. 5A. FIG. 5C is a cross-sectional view taken along the line C-C in FIG. 5A.

The spacer member 4 is formed of an elastically deformable material such as a resin. The spacer member 4 includes the elastic members 41 at the positions corresponding to the marks etc. on the operating surface 23. In this embodiment, as shown in FIG. 3, there are eight operational portions (i.e., the portions indicated by the marks etc.) on the operating surface 23. Therefore, the elastic members 41 also are provided at eight locations.

Each of the elastic members 41 is positioned within an opening 42, and can be deformed elastically in the direction of the arrow X in FIGS. 5B and 5C. Moreover, each of the elastic members 41 has an operating strip 41*a* at one end, and an arm 41*c* at the other end. A substantially Z-shaped bend 41*b* is connected between the operating strip 41*a* and the arm 41*c*.

One surface (shown in FIG. 5A) of the operating strip 41*a* receives the back surface of the elastically deformed thin-wall portion 25 (i.e., the surface in which the concave portion 24 is formed). The other surface (namely, the opposite surface to that shown in FIG. 5A) of the operating strip 41*a* can be pressed against the switch 51 mounted on the sub board 5. A projection is formed on the other surface of the operating strip 41*a* so as to press the switch 51 reliably. The operating strip 41*a* protrudes toward the first housing 2 with respect to the arm 41*c* because of the presence of the bend 41*b*.

The arms 41*c* are formed integrally with a bridging portion 45, and can be deformed elastically when the operating strips 41*a* are displaced in the direction of the arrow X by pushing the operating surface 23. In FIG. 5A, the spacer member 4 includes an outer elastic portion 141 located near the periphery of the spacer member 4 and an inner elastic portion 142 located near the center of the spacer member 4. The arms 41*c* of the elastic members 41 included in the outer elastic portion 141 are longer than those of the elastic members 41 included in the inner elastic portion 142. The reason for this is as follows. Since the rigidity is low around the center of the thin-wall portion 25, a sufficient amount of deformation can be ensured when the operating surface 23 is pushed. Therefore, even if the arms 41*c* are short, the switches 51 can be pressed reliably. In the vicinity of the periphery of the thin-wall portion 25, however, the rigidity is higher than that around the center. Thus, it is not possible to ensure a sufficient amount of deformation when the operating surface 23 is pushed. Accordingly, in the outer elastic portion 141, the rigidity of the arms 41*c* should be reduced to allow the elastic members 41 to be deformed easily, so that the switches 51 can be pressed reliably with a small amount of deformation of the thin-wall portion 25.

Assuming that the length of the arms 41*c* of the elastic members 41 included in the inner elastic portion 142 is the same as that of the arms 41*c* of the elastic members 41 included in the outer elastic portion 141, if the same pressure is applied to both the central and peripheral portions of the operating surface 23, the amount of deformation of the thin-wall portion 25 can vary from position to position due to the difference in rigidity between the center and the periphery of the thin-wall portion 25. This may result in a variation in the operation touch (hardness) of the operating surface 23 because the force generated in the opposite direction to the direction of pushing the operating surface 23 is the sum of the elasticity of the thin-wall portion 25 and the elasticity of the arm 41*c*. Therefore, the length of the arms 41*c* of the elastic members 41 in the inner elastic portion 142 is reduced to increase the rigidity, so that the operation touch (hardness) of the operating surface 23 can be made substantially the same in the outer and inner elastic portions 141, 142. Consequently, a variation in the operation touch (hardness) can be suppressed, and the product quality can be improved.

A first supporting member 43 is formed along the edge of the spacer member 4 and protrudes from the principal plane of the spacer member 4 in the normal direction. When the operating surface 23 is pushed, the first supporting member 43 can be brought into contact with the back surface of the thin-wall portion 25. Moreover, the surface (shown in FIG. 5A) of the first supporting member 43 is made slightly lower than the surfaces of the operating strips 41*a*. Therefore, the operating strips 41*a* are located closer than the first supporting member 43 to the back surface of the thin-wall portion 25 at the time the spacer member 4 is placed in the first housing 2.

Engaging portions 44 are provided on two opposite sides of the spacer member 4 and engage with holes 52 formed in the sub board 5, thereby fastening the spacer member 4 to the sub board 5. In this embodiment, the spacer member 4 is fixed to the sub board 5 by the engagement of the engaging portions 44 with the holes 52, but it also may be fixed using other means such as screws.

The bridging portion 45 corresponds to the portion other than the elastic members 41, the openings 42, the first supporting member 43, and the engaging portions 44 in the spacer member 4.

In the configuration of FIGS. 4 and 5, when the operating surface 23 is pushed so that the thin-wall portion 25 is deformed elastically, the amount of deformation of the thin-wall portion 25 can be controlled by allowing the back surface of the thin-wall portion 25 to come into contact with the first supporting member 43. Moreover, the amount of deformation also can be controlled by allowing the central portion of the back surface of the thin-wall portion 25 to come into contact with the bridging portion 45. In other words, a "supporting member" may include both the first supporting member 43 and the bridging portion 45. Thus, it is possible to prevent the periphery of the operating surface 23 or the thin-wall portion 25 from being deformed significantly as well as being damaged.

Figure 6:
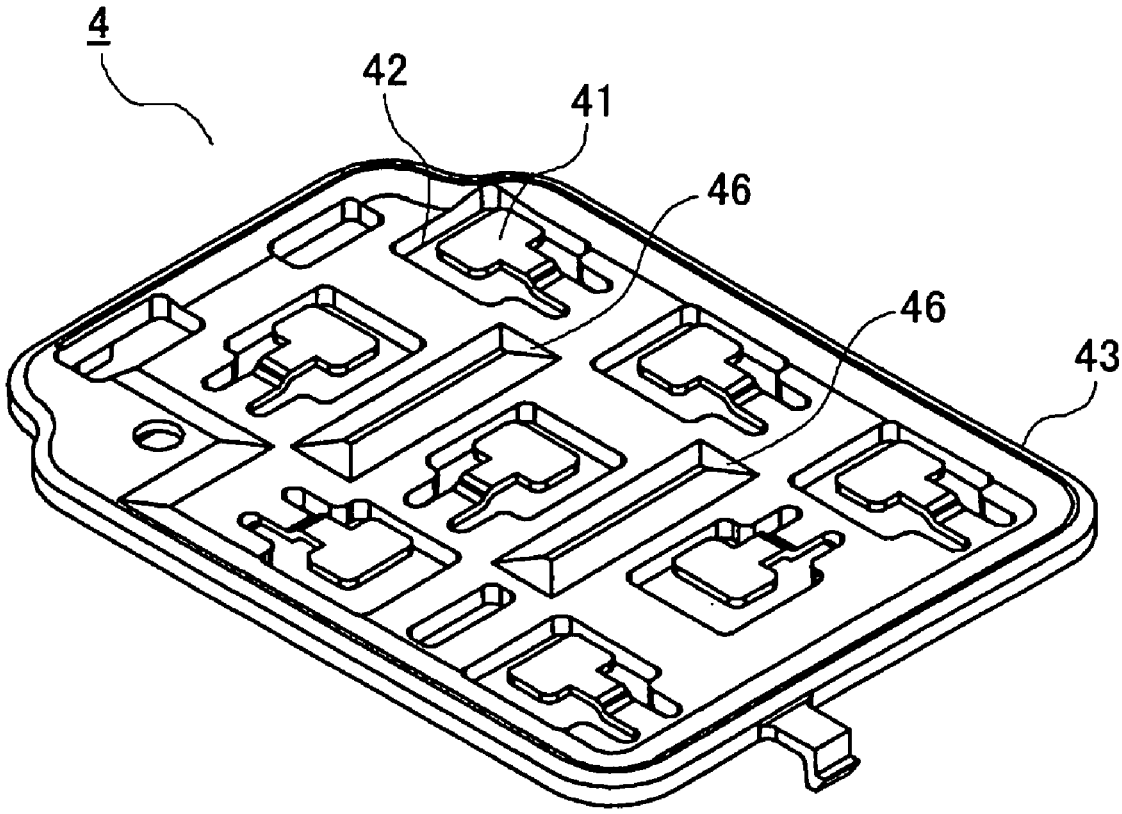
FIG. 6 is a perspective view showing another configuration of a spacer member of the embodiment.
Figure 7A:
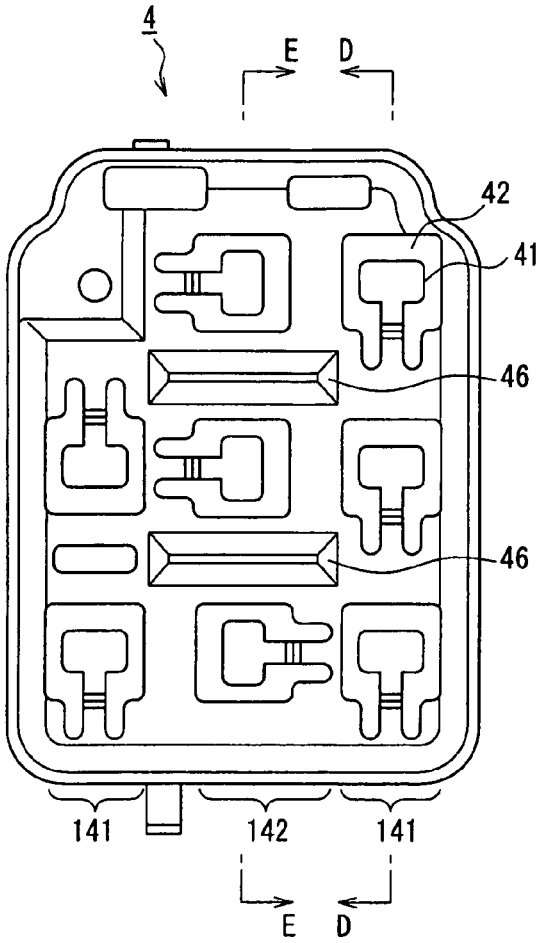
FIG. 7A is a plan view showing the configuration of the spacer member in FIG. 6.
Figure 7B:
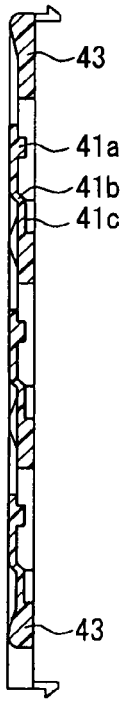
FIG. 7B is a cross-sectional view showing the configuration of the spacer member in FIG. 6.
Figure 7C:
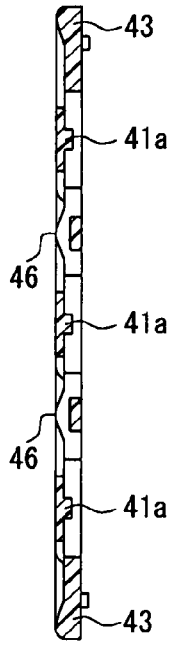
FIG. 7C is a cross-sectional view showing the configuration of the spacer member in FIG. 6.

FIGS. 6, 7A, 7B, and 7C show another configuration of the spacer member 4. FIG. 7B is a cross-sectional view taken along the line D-D in FIG. 7A. FIG. 7C is a cross-sectional view taken along the line E-E in FIG. 7A. A spacer member shown in FIGS. 6 and 7 is configured by adding second supporting members 46 to the spacer member shown in FIGS. 4 and 5. The second supporting members 46 are formed between each of the elastic members 41 included in the inner elastic portion 142. That is, the second supporting members 46 are located at the positions that separate the elastic members 41 from each other. The height of the second supporting members 46 is the same as that of the first supporting member 43.

The second supporting members 46 can prevent an operation error in which a plurality of switches 51 are pressed simultaneously by the spacer member 4 while a user pushes a single portion of the operating surface 23. In the absence of the second supporting members 46, when the thin-wall portion 25 is depressed by pushing the operating surface 23, two or more adjacent elastic members 41 may be pressed simultaneously by the back surface of the thin-wall portion 25, and then forced simultaneously against two or more adjacent switches 51. In particular, the amount of deformation is large around the center of the thin-wall portion 25, and therefore the above operation error is likely to occur when the central portion of the operating surface 23 is pushed. By forming the second supporting members 46 as shown in FIG. 6, the amount of deformation of the thin-wall portion 25 can be controlled, so that only the portion pushed by a user can be deformed greatly. Thus, it is possible to prevent the operation error in which two or more elastic members 41 are pressed simultaneously by the back surface of the thin-wall portion 25, and then forced simultaneously against two or more switches 51. In this embodiment, the second supporting members 46 are provided at two locations, but not limited to this number. Moreover, the second supporting members 46 are formed so as to protrude from the principal plane of the spacer member 4 and taper toward the top, as shown in FIG. 6. However, the shape of the top portion of the second supporting member 46 is not particularly limited, and may be sharp, flat, or rounded.

The arms 41*c* of the elastic members 41 included in the inner elastic portion 142 are formed in the direction substantially perpendicular to the arms 41*c* of the elastic members 41 included in the outer elastic portion 141. As described above, since a large amount of deformation is not required in the inner elastic portion 142, the length of the arms 41*c* can be short. Therefore, the inner elastic portion 142 has a high degree of freedom in layout. When the arms 41*c* of the elastic members 41 in the inner elastic portion 142 are formed in the direction substantially perpendicular to the arms 41*c* of the elastic members 41 in the outer elastic portion 141, a space is produced between each of the elastic members 41 in the inner elastic portion 142. By forming the second supporting members 46 in these spaces, they can be arranged without increasing the size of the spacer member 4. Moreover, the space between the elastic members 41 can be made narrower, so that a larger number of elastic members 41 and switches 51 can be arranged.

The second supporting member 46 is made of a resin and has a tapered top portion. On the other hand, the first housing 2 is provided with the thin-wall portion 25 opposite to the spacer member 4. Therefore, if the top portion of the second supporting member 46 is sharp in shape, the back surface of the thin-wall portion 25 may come into line contact with the top portion when it is deformed elastically by pushing the operating surface 23. Consequently, an edge line may appear on the operating surface 23 due to the top portion of the second supporting member 46. In such a case, an elastic member with substantially the same size may be used instead of the second supporting member 46. The elastic member is preferably made of sponge or the like. With the use of the elastic member, when the operating surface 23 is pushed, the back surface of the thin-wall portion 25 is pressed into face contact with the elastic member because its shape is changed. Thus, the appearance of the edge line on the operating surface 23 can be suppressed. Although the elastic member is formed of sponge and with substantially the same shape as the second supporting member 46, it does not necessarily employ the same shape and the above material. The shape and material of the elastic member may be selected so that at least when the operating surface 23 is pushed, the elastic member can be brought into contact with the back surface of the thin-wall portion 25 to prevent an operation error in which two switches 51 are pressed simultaneously.

3. Operation of the Electronic Equipment

Figure 8:
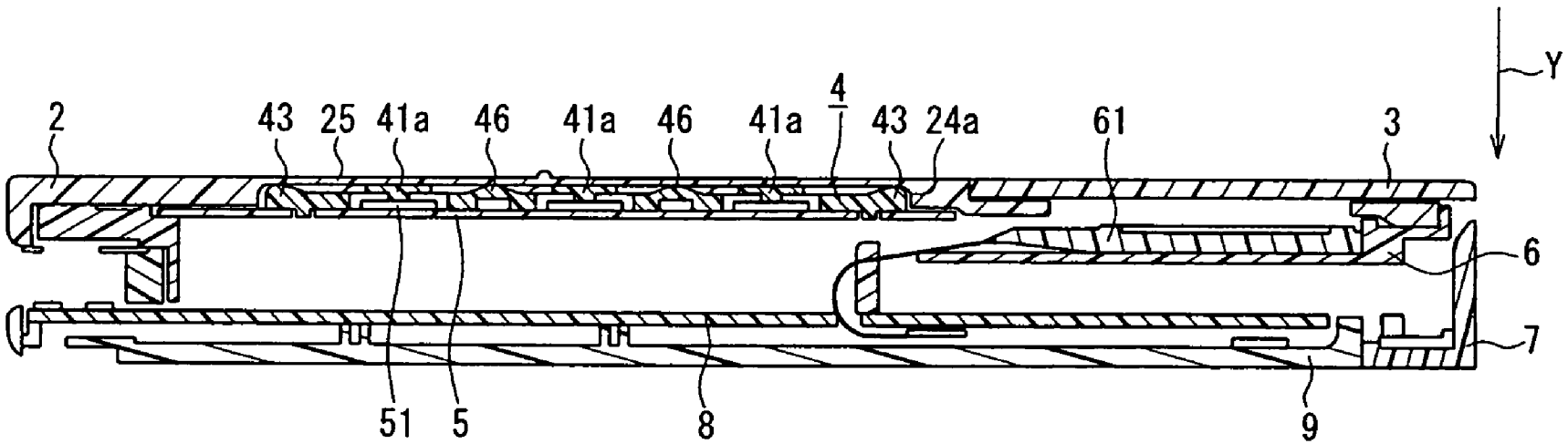
FIG. 8 is a cross-sectional view of an operating device of the embodiment.

FIG. 8 is a cross-sectional view of the electronic equipment taken along the line A-A in FIG. 3. The spacer member 4 contained in the electronic equipment of FIG. 8 is the same as shown in FIGS. 6 and 7. In FIG. 8, components unnecessary (battery etc.) for explanation of this section are omitted.

As shown in FIG. 8, when the operating surface 23 is not pushed, the back surface of the thin-wall portion 25 may be either in contact with or a small distance (e.g., 0.1 mm) apart from the operating strip 41*a*. Moreover, the back surface of the thin-wall portion 25 is a small distance (e.g., 0.3 mm) apart from each of the first and second supporting members 43, 46. With this configuration in which the back surface of the thin-wall portion 25 is in contact with or a small distance apart from the operating strip 41*a* when the operating surface 23 is not pushed, the elastic member 41 can be deformed and pressed against the switch 51 with small pressure applied to the operating surface 23. Thus, the direct operation touch can be achieved. Moreover, the distance between the back surface of the thin-wall portion 25 and the operating strip 41*a* is smaller than that between the back surface of the thin-wall portion 25 and each of the first and second supporting members 43, 46. This makes it possible not only to ensure a sufficient amount of deformation of the thin-wall portion 25, but also to prevent an operation error in which two switches 51 are pressed simultaneously when the thin-wall portion 25 is depressed greatly.

In the non-operating state shown in FIG. 8, when a user pushes the portion of the operating surface 23 indicated by the mark etc. in the direction of the arrow Y, the thin-wall portion 25 starts to be deformed elastically in the direction of the arrow Y. First, the back surface of the thin-wall portion 25 comes into contact with the operating strip 41*a* of the elastic member 41. As the thin-wall portion 25 is deformed further, the back surface then comes into contact with the first and second supporting members 43, 46. Moreover, as the thin-wall portion 25 moves even further, the back surface is pressed against the operating strip 41*a*, causing the elastic member 41 to be deformed elastically. As a result, the back surface of the operating strip 41*a* is forced against the switch 51, so that the switch 51 is activated.

At this time, since the back surface of the thin-wall portion 25 is in contact with the second supporting member 46, the deformation of the portions other than that pushed by a user can be suppressed, thus preventing an operation error in which two or more adjacent switches 51 are pressed simultaneously. For example, in the case where a user pushes the portion indicated by the play/pause mark 23*a* in FIG. 3, if the spacer member 4 includes no second supporting member, there is a possibility that the elastic member 41 is pressed not only against the switch 51 under the play/pause mark 23*a*, but also against the switch 51 under the volume up mark 23*b* or the volume down mark 23*c*, which are adjacent to the play/pause mark 23*a*, simultaneously. Because of the presence of the second supporting members 46, as shown in FIGS. 6 and 7, when a user pushes the portion indicated by the play/pause mark 23*a*, the amount of deformation of the thin-wall portion 25 can be controlled so as to suppress the deformation of the portions indicated by the volume up mark 23*b* and the volume down mark 23*c*. Thus, it is possible to prevent the switches 51 arranged under the volume up mark 23*b* and the volume down mark 23*c* from being operated.

When a user releases the operating surface 23, the thin-wall portion 25 and the elastic member 41 return to their original shapes, and the operating strip 41*a* is separated from the switch 51.

4. Effect and Others of this Embodiment

In this embodiment, the elastically deformable thin-wall portion 25 is formed as a part of the first housing 2, and the surface of the thin-wall portion 25 is used as the operating surface 23. This configuration can prevent water etc. from entering the main unit 1, since no gap is present on the operating surface 23.

The portion of the first housing 2 where the operating surface 23 is provided is formed of the thin-wall portion 2, and therefore can be deformed elastically. Thus, an operating member can be achieved without fixing an additional member (e.g., corresponding to the band of Patent Document 1) to the surface of the first housing 2, resulting in electronic equipment of good integrated design.

By using the spacer member 4, the desired switch 51 can be pressed with a small amount of deformation of the thin-wall portion 25, so that the operability can be improved. Moreover, since the amount of deformation of the thin-wall portion 25 can be reduced, the load imposed on the first housing 2 also can be reduced during the push operation. Thus, a fatigue failure of the first housing 2 can be suppressed.

The spacer member 4 includes the first supporting member 43 that is capable of receiving pressure applied to the operating surface 23. Therefore, it is possible to prevent plastic deformation of the first housing 2 or a fracture of the first housing 2 when large pressure is applied to the operating surface 23.

The spacer member 4 includes the second supporting members 46. This configuration can prevent the thin-wall portion 25 from being depressed more than necessary when the operating surface 23 is pushed, and thus can prevent an operation error in which a plurality of switches 51 are pressed simultaneously. In particular, the second supporting members 46 are formed under the central portion of the operating surface 23 where the rigidity is low, so that the practical effect is large.

The curved portions 24*a* are provided on the inner surface of the concave portion 24. This configuration can disperse the stress applied intensively to the inner surface of the concave portion 24 during the push operation, and also can suppress cracks or the like on the periphery of the operating surface 23 of the first housing 2. In particular, it is possible to prevent a fracture of the first housing 2 while the operating surface 23 is pushed repeatedly.

The arms 41*c* of the elastic members 41 included in the outer elastic portion 141 are longer, so that the elastic members 41 can be deformed and pressed against the switches 51 only by slightly depressing the thin-wall portion 25. Since the rigidity of the operating surface 23 is higher in the peripheral portion than in the central portion, the peripheral portion is not likely to be deformed during the push operation. Therefore, by reducing the rigidity of the arms 41*c* of the elastic members 41 in the outer elastic portion 141, the elastic members 41 can be deformed with a small amount of deformation of the thin-wall portion 25.

The present invention relates to an operating device that can perform various operations by applying pressure. In particular, the operating device is well-sealed and useful for portable equipment that can be used outdoors. The operating device is applicable to, e.g., a portable audio player, a portable telephone, a digital still camera, and a personal computer, but is not limited thereto.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. Electronic equipment comprising:

a housing with an elastically deformable thin-wall portion formed as a part of a front wall;

an elastically deformable spacer member located on a back side of the thin-wall portion in the housing; and a sub board on which switches that can be pressed by the spacer member are mounted, wherein the spacer member comprises:

a plurality of elastic members, each of which comprises an operating strip that is formed so that when the thin-wall portion is deformed elastically, one surface of the operating strip can be brought into contact with a back surface of the thin-wall portion and the other surface can be pressed against the switch;

a bridging portion that holds arms for supporting the operation strips; and a supporting member that is formed so as to protrude above the bridging portion between each of the elastic members, and can be brought into contact with the back surface of the thin-wall portion at least when the thin-wall portion is deformed elastically, and wherein the elastic members and the supporting member are formed integrally, and a surface of the bridging portion is positioned lower than upper surfaces of the supporting member and the operating strips.

2. The electronic equipment according to claim 1, wherein the arms are formed so as to extend from each of the operating strips to the bridging portion with a bend therebetween.

3. Electronic equipment comprising:

a housing with an elastically deformable thin-wall portion formed as a part of a front wall:

an elastically deformable spacer member located on a back side of the thin-wall portion in the housing; and a sub board on which switches that can be pressed by the spacer member are mounted, wherein the spacer member comprises:

a plurality of elastic members, each of which comprises an operating strip that is formed so that when the thin-wall portion is deformed elastically, one surface of the operating strip can be brought into contact with a back surface of the thin-wall portion and the other surface can be pressed against the switch; and a supporting member that is formed so as to protrude between each of the elastic members, and can be brought into contact with the back surface of the thin-wall portion at least when the thin-wall portion is deformed elastically, wherein the elastic members and the supporting member are formed integrally, and wherein a distance between the supporting member and the back surface of the thin-wall portion is larger than that between the operating strip and the back surface of the thin-wall portion.

* * * * *